United States Patent [19]

Fisher et al.

[11] 4,198,724

[45] Apr. 22, 1980

[54] AUTOMATIC WINDOW WASHER

[75] Inventors: Sidney L. Fisher; Harry S. Fisher; Ole E. Leivestad, all of Renton, Wash.

[73] Assignee: Spider Staging, Inc., Seattle, Wash.

[21] Appl. No.: 921,325

[22] Filed: Jul. 3, 1978

[51] Int. Cl.[2] ..... A47L 1/04

[52] U.S. Cl. ..... 15/302; 15/50 A; 15/103

[58] Field of Search ..... 15/50 R, 50 C, 50 A, 15/103, 302, 320, 321, 322

[56] References Cited

U.S. PATENT DOCUMENTS

| | | | |
|---|---|---|---|
| 3,040,363 | 6/1962 | Krammes et al. | 15/320 |
| 3,080,592 | 3/1963 | Hassage | 15/103 X |
| 3,344,454 | 10/1967 | Mikalson | 15/50 C |
| 4,025,984 | 5/1977 | Hoener, Jr. | 15/302 |
| 4,136,419 | 1/1979 | Hetman et al. | 15/302 |

*Primary Examiner*—Christopher K. Moore

*Attorney, Agent, or Firm*—Delbert J. Barnard

[57] ABSTRACT

The window washer is suspended from the top of a building by a suspension line and moves up and down the line while cleaning the side of the building. Cleaning liquid is dripped onto brushes which scour the surface to be cleaned. A squeegee in wiping contact with the wetted surface wipes the cleaning liquid from such surface and collects it generally at a leading edge portion of the squeegee. Then, collected cleaning liquid is removed by suction.

26 Claims, 10 Drawing Figures

224
222
152
150
256
254
34
258
46
211
216
260
213
28
44
278
276
25
146
148
128
140
138
126
134
144
136
282
284
290
124
286
22
26
23
154
160
162
156
132
114
163
165
167
166
164
280
230
252
142
47
220
32
30
36
212

AUTOMATIC WINDOW WASHER

BACKGROUND OF THE INVENTION

1. Field of the Invention

This invention relates to automatic washing machines for cleaning vertical surfaces, and in particular to an automatic window washer which is suspended from the top of a building by a suspension line to move up and down over the face of the building while cleaning the building windows.

2. Description of the Prior Art

In the past, the exterior of taller buildings were generally constructed from either stone or brick and were designed more ornately than more modern buildings. Often decorative portions of the building extended outwardly a considerable distance from the window surface. Furthermore, many of the taller old buildings were constructed with a step back so that the floor area of the building decreased as the building extended upwardly. The windows in these buildings were of the double-hung type which could be opened to provide ventillation within the building. These windows were generally manually cleaned by workmen, either standing on a staging, or sitting in a sling suspended from a suspension line anchored at the top of the building.

Buildings being constructed today are taller and less ornate than buildings constructed in the past. They are generally framed with structural steel and have a rather smooth or flat outer surface constructed from concrete, stone or metal panels. Moreover, the windows do not open, but are fixed, and constitute a larger percentage of the surface area of the building than was common in older buildings. Usually, the windows are arranged in vertical columns which are defined by vertical mullions interspaced between the windows. The windows, furthermore, are usually not inset very deeply in respect to the exterior surface of the adjacent non-glazed portions of the building exterior. Because of the relative increase in the window area of a building, the increased average height of buildings, and the increased wage rate for manual labor; the cost of manually cleaning the glazed area of a building has risen dramatically during the past decade. Also, due to the sheer height of many modern buildings and the substantial distance that they sway back and forth, the manual cleaning of windows has become more dangerous, thus enlarging the need for efficient automatic window washers.

Automatic window washers per se are not new. In general, these devices have consisted of means for spraying cleaning liquid onto windows being cleaned, a moving brush or roller for scrubbing the wetted windows, and means for removing the cleaning fluid and dirt from the windows. The means for removing the cleaning liquid from the windows have usually consisted of a squeegee or sponge to wipe the window. Also, a rapidly flowing air current generated by a blower or a vacuum source has been used by itself or in combination with a squeegee or sponge to blow or suck the cleaning liquid from the windows.

In operation these window washers have been moved up and down the face of a building by suspension cables. Following each vertical pass, an apparatus on the roof of the building to which the upper end of the suspension cable is attached is stepped into position sideways so that the next vertical pass of the window washer will be alongside the former vertical pass. The window washer itself may include a cable drum and a motor for raising and lowering the apparatus, or a cable drum and motor may be incorporated in the support apparatus located on the roof of the building. Furthermore, the window washer may include means for urging the scrubber brush, as a unit, into contact with the window being washed.

One disadvantage of at least some known automatic window washers is that they can satisfactorily clean a window only while moving in one direction, either only upwardly or only downwardly. This results in much time being wasted waiting for the apparatus to be retracted to its starting position. A second disadvantage of known automatic window washers is that they require a relatively large amount of water to clean a given window area. Because these devices generally spray the cleaning liquid directly on the window and because the scrubber brushes and removal means are generally not positioned very close to the location at which the cleaning liquid is sprayed on the window, a large amount of water is needed to adequately and uniformly wet the window and to keep the dirt particles in suspension in the cleaning liquid for a sufficient length of time to enable the removal means to collect the cleaning liquid and the suspended dirt prior to the cleaning liquid evaporating away. Furthermore, due to the limited amount of weight supportable by a suspension line support system, either (1) the window washer must be refilled quite often, perhaps even before making one pass, (2) the dirty used water must be recycled, or (3) a complicated filtration system must be used to clean the used water. Another disadvantage is that even if the window washer has means for advancing the scrubber forward into contact with the window, the scrubber unit as a whole can only be advanced or retracted in a direction normal to the face of the building. Thus, these window washers cannot satisfactorily clean windows which lie in a plane vertically askewed from the general plane of the building surface.

Examples of known automatic window washers are disclosed by the following U.S. patents: U.S. Pat. No. 1,416,280, granted May 16, 1922, to Joseph Gadzzicki; No. 3,298,052, granted Jan. 17, 1967 to Max G. Wolfe; No. 3,497,902, granted Mar. 3, 1970, to John Hartigan; No. 3,604,049, granted Sept. 14, 1971, to Frank W. Hetman; No. 3,775,804, granted Dec. 4, 1973, to Ralph W. Hoener, Jr.; and No. 3,942,213, granted Mar. 9, 1976, to Ralph W. Hoener, Jr. These patents and the prior art that was cited and considered by the Patent Office before granting them and which is listed on the patents should be consulted for the purpose of properly evaluating the subject invention and putting it into proper perspective.

BRIEF SUMMARY OF THE INVENTION

Vertical surface washing machines according to the present invention are basically characterized by at least one brush which in use is in contact with the vertical surface; means for dripping cleaning liquid onto said brush in a sufficient amount to keep such brush wet and enable it to apply a film of cleaning liquid onto the vertical surface; power means for moving said brush relative to said vertical surface, so that the brush will both scrub such surface and apply a film of cleaning liquid onto it; squeeqee means mounted in close proximity to said brush, which squeegee in use makes wiping contact with the portion of the vertical surface which being cleaned and functions to wipe the cleaning liquid from such surface and collect it generally at a leading edge portion of said squeegee; and a suction system for removing the cleaning liquid from the leading edge region of the squeegee.

In preferred form the machine includes a frame which is guided to move vertically up and down along a vertical surface in defined paths of travel. The brush is in the form of a horizontally disposed, elongate, bristle wall and is powered for reciprocating movement to both scrub and apply a film of cleaning liquid to the vertical surface being cleaned. Dripping the cleaning liquid on the moving brush enables a relatively small quantity of cleaning liquid to be used both to wet a relatively large vertical surface area and to serve as a suspension medium for the particles removed from the vehicle surface. Furthermore, by only requiring a minimum quantity of cleaning liquid to satisfactorily clean a given surface area, valuable time is not spent having to repeatedly refill the reservoir with fresh cleaning liquid. Extend-retract means are provided to extend the brush forwardly into working contact and to retract it rearwardly away from the vertical surface; and biasing means maintain the brush in uniform working pressure against the vertical surface.

Each squeegee is generally in the form of a flexible blade, which blade is mounted on the forward section of a vacuum manifold and is carried by said manifold in close proximity to the brush. Locating the squeegees near the brush enables the used cleaning liquid, together with the suspended solids, to be removed from the vertical surface prior to being evaporated due to the ambient heat. The suction system includes internal passageways extending through the squeegee blade, which passageways are in fluid flow communication with the vacuum manifold. The passageways have inlets in the region of the blade whereat the cleaning liquid is collected. This construction of the suction system only requires a small use of an amount of suction in conjunction with the wiping action of the squeegee blade to effectively remove all of the used cleaning liquid from the vertical surface. Thus, no appreciable quantity of cleaning liquid remains on the vertical surface which could fall downward onto the sidewalk or passersbys below.

Extend-retract means, which interconnect the vacuum manifold and the frame, function both to extend the squeegees forwardly into operative positions continguous the vertical surface and to retract the squeegees into inoperative position rearwardly away from the vertical surface. The squeegee extend-retract means includes biasing means for maintaining extended squeegees in uniform working pressure against the vertical surface.

It is an object of the present invention, therefore, to provide a washing machine for rapidly, efficiently and automatically cleaning a vertical surface.

Another object of the present invention is to provide a washing machine which is capable of cleaning a vertical surface while traveling both upwardly and downwardly along the surface.

A further object of the present invention is to provide a vertical surface washing machine which is capable of cleaning a large surface area with a minimum quantity of cleaning liquid.

Still another object of the present invention is to provide a washing machine to clean a vertical surface without dripping any of the cleaning liquid onto the ground below.

One more object of the present invention is to provide a vertical surface washing machine which automatically adjusts to the plane of a window which may be askewed relative to the outer surface of a building.

DESCRIPTION OF THE PREFERRED EMBODIMENT

In General

Figure 2:
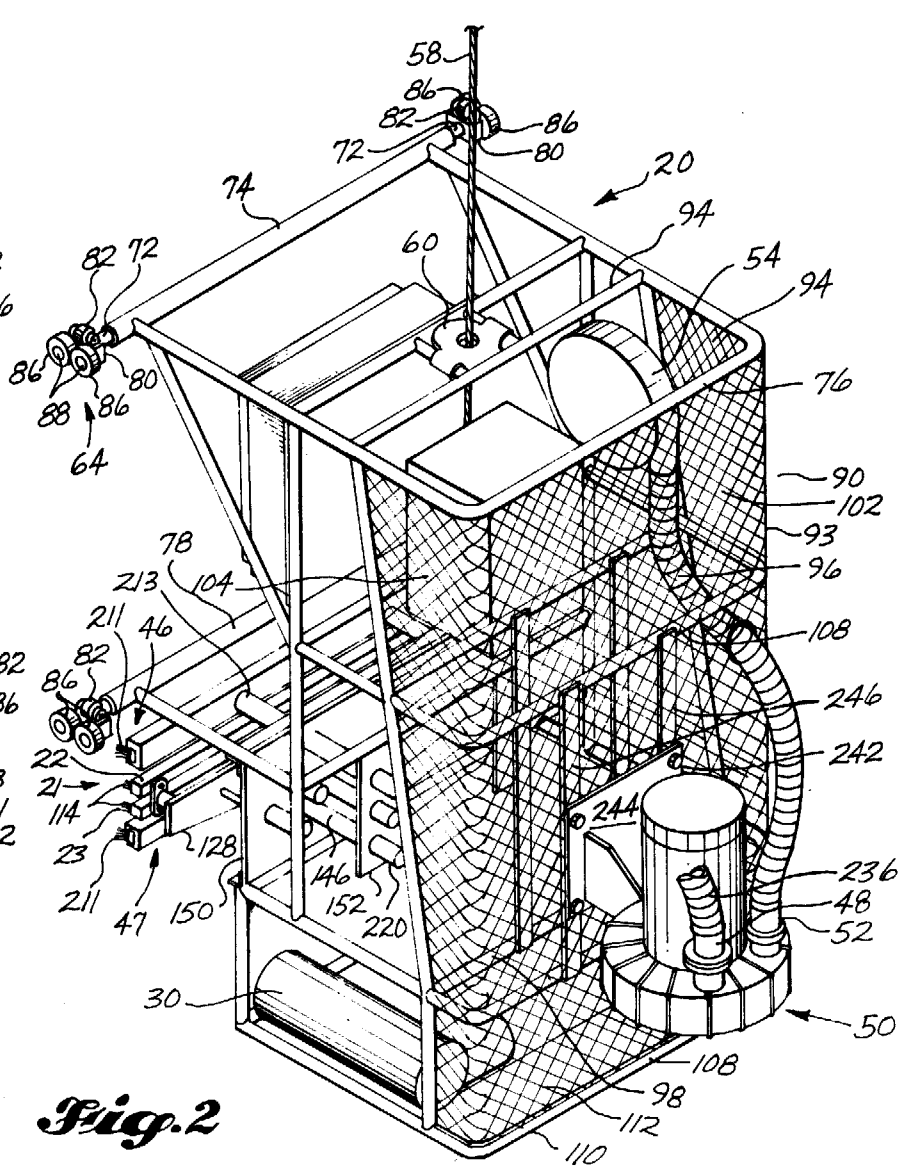
FIG. 2 is a rear pictorial of the vertical surface washing machine also shown suspended from a suspension line and shown with parts removed.
Figure 1:
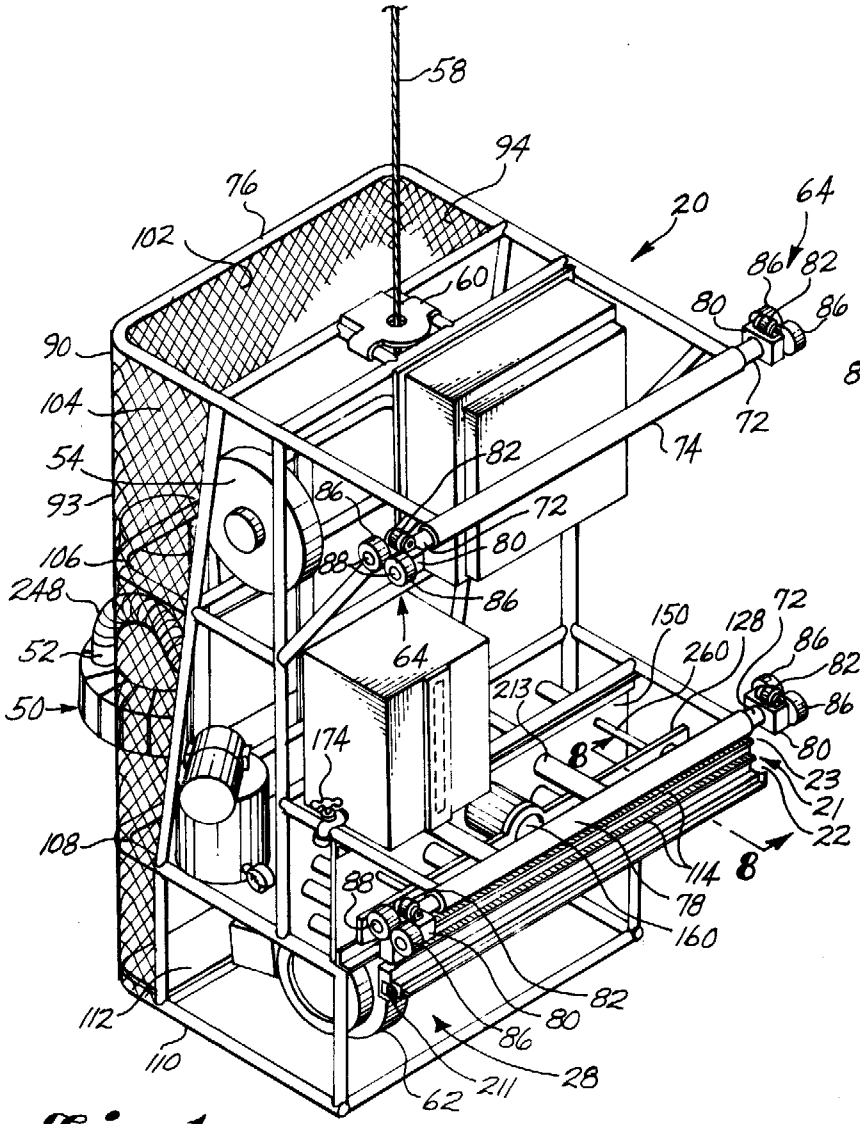
FIG. 1 is a front pictorial view of an embodiment of the vertical surface washing machine of the present invention shown suspended from a suspension line. In use the front of the vertical surface washing machine is positioned adjacent the vertical surface to be washed.
Figure 3:
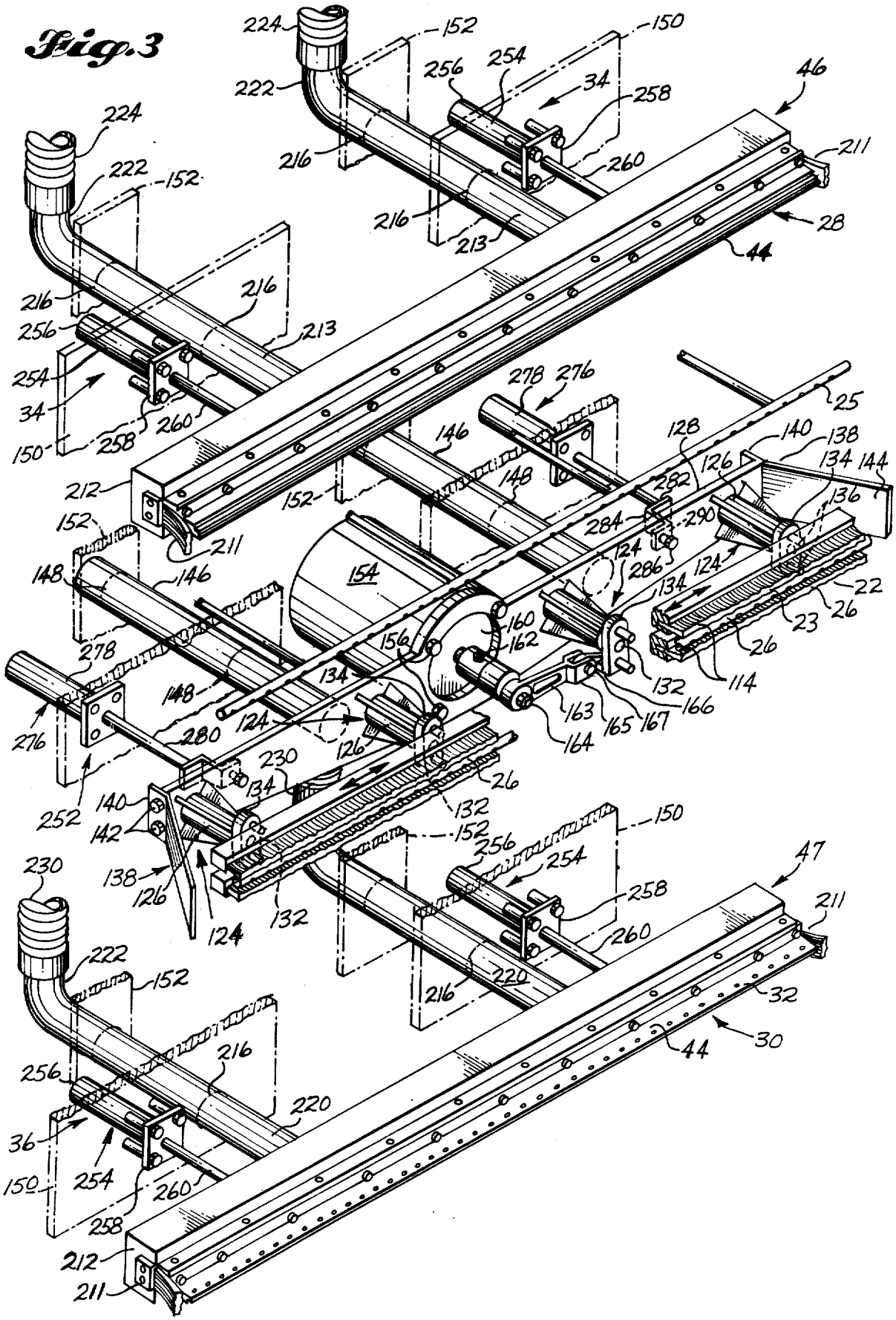
FIG. 3 is an exploded, partial pictorial view of the vertical surface washing machine with portions of the frame shown in broken line and specifically illustrating the dripping means, squeegees, and suction system.
Figure 4:
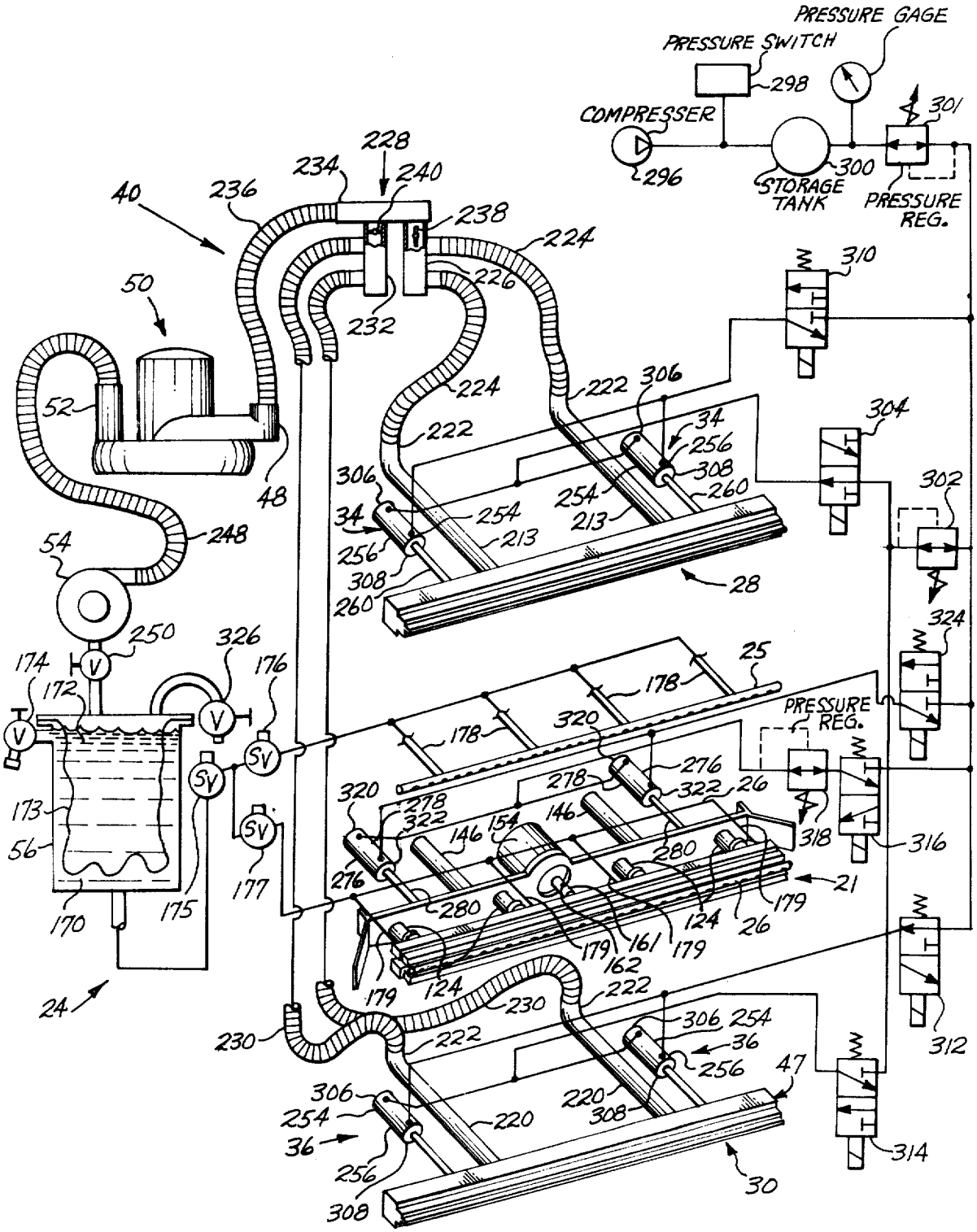
FIG. 4 is a schematic view of the vertical surface washing machine specifically illustrating the circuit diagram for the extend-retract means of the squeegees and brush means, which circuit diagram is switched for downward travel of the vertical surface washing machine.
Figure 8:
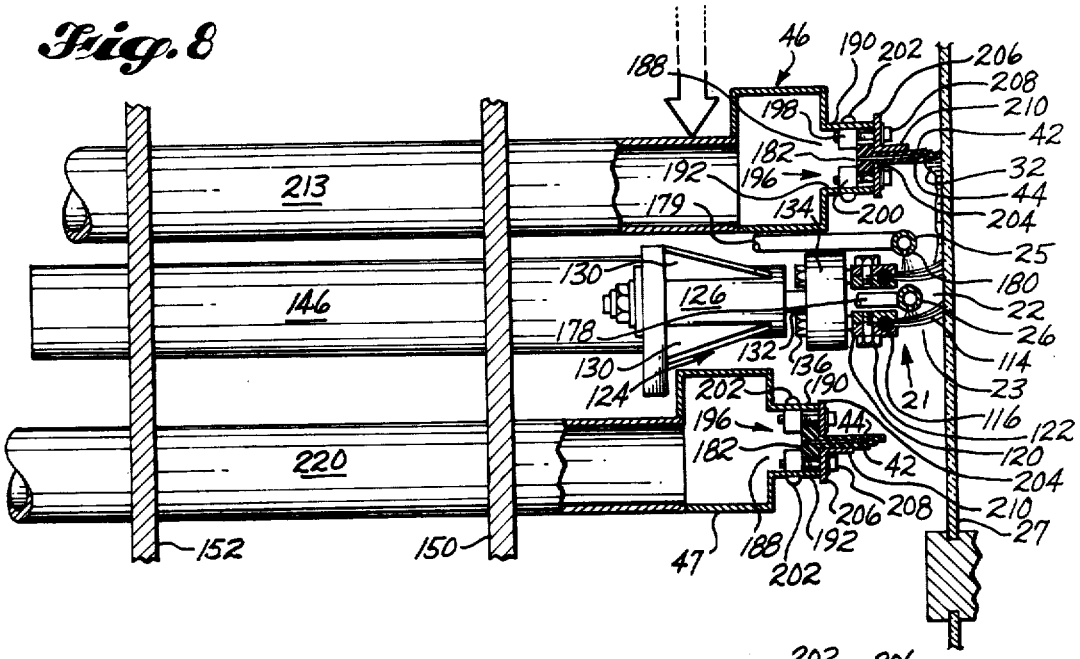
FIG. 8 is a partial cross-sectional view of the vertical surface washing machine shown in FIG. 1 taken substantially along lines 8—8 thereof and illustrating the present invention as it travels downwardly along a vertical surface.
Figure 9:
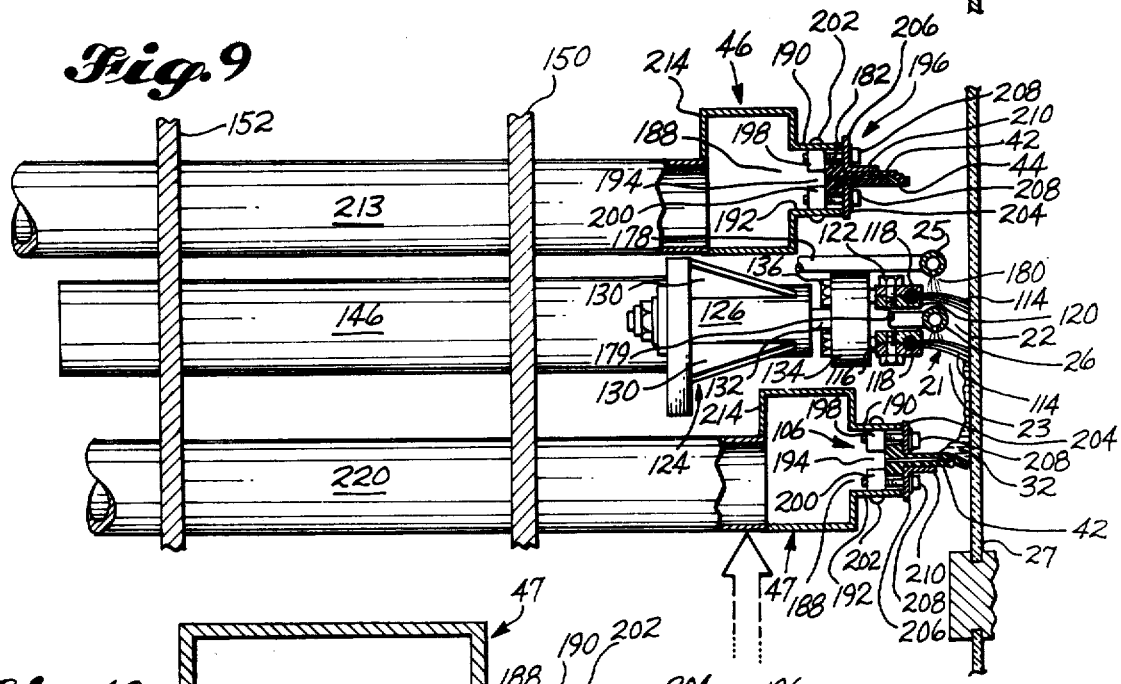
FIG. 9 is a partial cross-sectional view of the vertical surface washing machine similar to FIG. 8 except with the present invention shown traveling upwardly along the vertical surface.

Referring initially to FIGS. 1 and 2, shown in pictorial views is a typical vertical surface washing machine constructed according to the instant invention. In preferred form and best mode, it comprises a suspended frame 20, on which frame is mounted brush means 21 in the form of horizontally disposed upper brush 22 and a lower brush 23. Said two brushes are spaced vertically above each other for lengthwise reciprocating movement. Also carried by frame 20 are cleaning liquid supply means 24, shown schematically in FIG. 5, which supply means includes an upper distributor pipe 25 located closely above upper brush 22 and a lower distributor pipe located closely above lower brush 23. Cleaning liquid is selectively discharged downwardly from one of said two distributor pipes onto either brush 22 or 23 in an amount sufficient to keep said selected brush wet so that a film of cleaning liquid is applied by said selected brush onto the vertical column of windows 27 being washed. As best shown in FIGS. 8 and 9, an upper squeegee 28 and a lower squeegee 30 are carried by frame 20 in locations closely above and closely below, respectively, brush means 21, said two squeegees selectively function to wipe the cleaning liquid from window 27 and then collect it generally at a leading edge portion 32 of said selected squeegee. When frame 20 is traveling downwardly, as shown in FIG. 8, the upper or trailing squeegee 28 is extended forwardly into wiping contact with window 27 by powered, upper extend-retract means 34 and correspondingly the lower squeegee 30 is retracted rearwardly into inoperative position by powered, lower extend-retract means 36, as best shown in FIGS. 3 and 8. Alternatively, when frame 20 is traveling in an upwardly direction, the lower extend-extact means 36 extends the lower or trailing squeegee 30 forwardly into wiping contact with window 27 while upper squeegee 28 is retracted rearwardly away from vertical surface 23 by upper extend-retract means 34. A suction system 40, as shown schematically in FIG. 4, is provided to remove the used cleaning liquid and a certain amount of surrounding air from the leading edge portion 32 of squeegees 28 and 30. Said suction system includes passageways 42 extending through blade portion 44 of said two squeegees. Used cleaning liquid is drawn through passageways 42 and collected alternatively in an upper vacuum manifold 46 or lower vacuum manifold 47 and then is drawn into the intake side 48 of vacuum pump 50. Therefrom, the cleaning liquid and air mixture is discharged through exit side 52 of vacuum pump 50 and into separator 54 wherein the used cleaning liquid and air are separated so that such used cleaning liquid, by itself, can be conveniently stored in tank 56.

Staging

Now referring specifically to FIGS. 1 and 2, frame 20 is shown suspended from a suspension line 58 extending from an anchored position above (not shown) downwardly through a fairlead 60 mounted at the top of frame 20 and then further downwardly to a power-driver winch drum 62 onto and off from which line 58 is wound. Said winch drum 62 is located in the bottom portion of frame 20 and is preferably driven by a variable speed, reversible electric motor mounted closely adjacent said winch drum and suitably connected thereto by gear reduction means. The control circuit for the electric drive motor includes a suitable switch mechanism operable to control the direction of rotation of the reversible motor. Preferably, a rheostat is provided in series between the switch mechanism and motor and is used for varying the rotational speed of the motor and the winch drum so as to in turn vary the rate of upwardly or downwardly travel of frame 20 in response to the condition of window 27.

Frame 20 is shown in FIGS. 1 and 2 as constructed of straight and formed sections of a round tubular material which sections have been joined together preferably by welding. The tubular sections are preferably of a lightweight, strong, corrosion resistant material such as aluminum. Furthermore, it is to be understood that the frame sections can readily be formed from tubular members having other cross-sections, such as square or rectangular.

Figure 5:
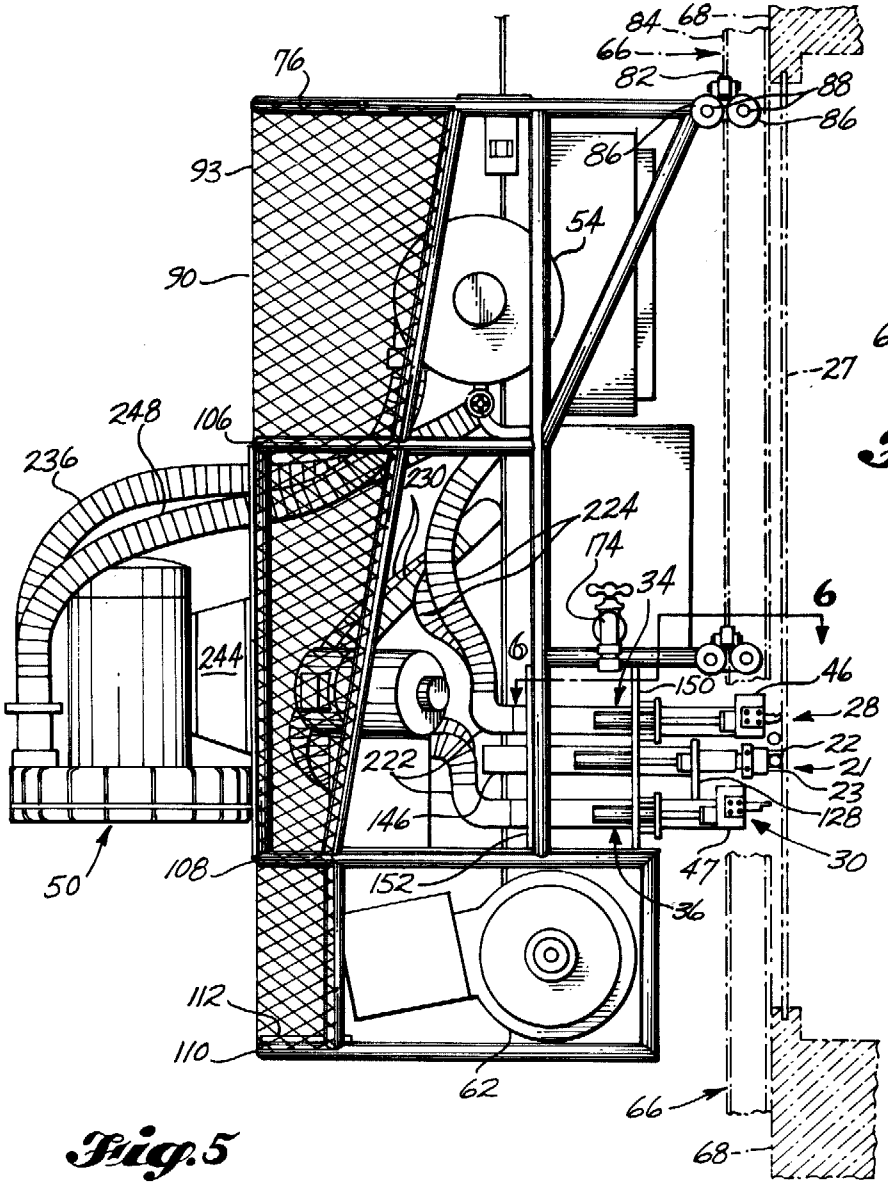
FIG. 5 is a side elevational view of the vertical surface washing machine with portions of a building shown in broken lines.
Figure 6:
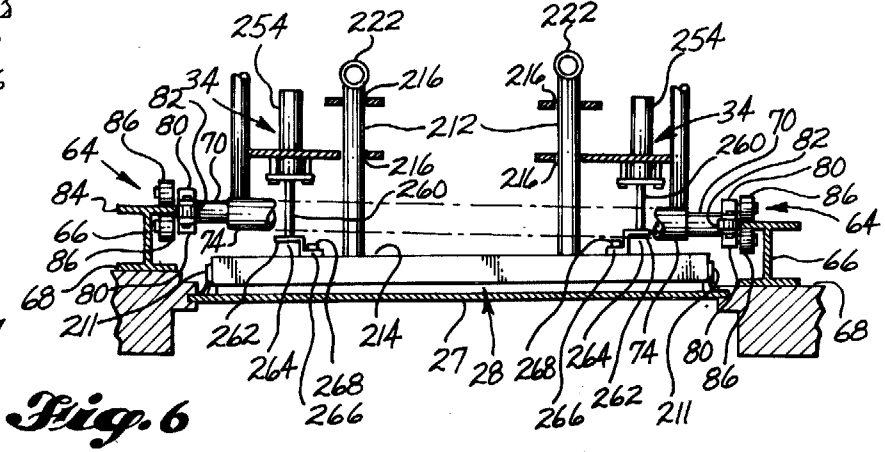
FIG. 6 is a partial cross-sectional view of the vertical surface washing machine shown in FIG. 5 taken substantially along lines 6—6 thereof.
Figure 7:
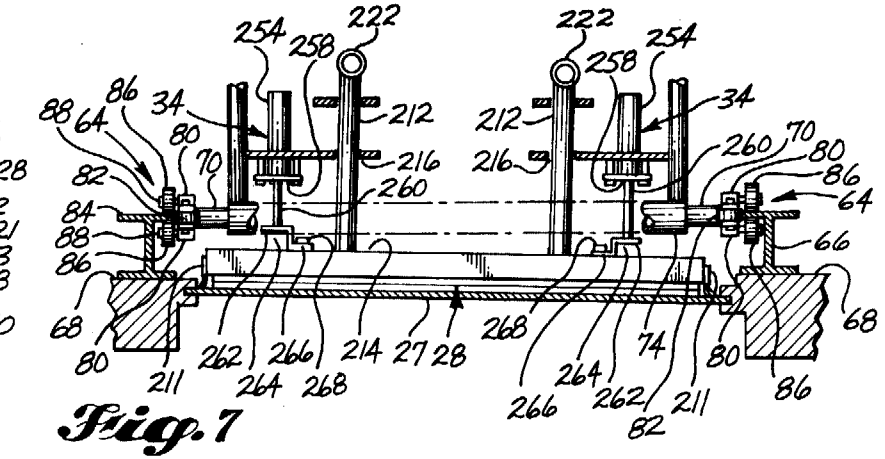
FIG. 7 is a partial cross-sectional view of the vertical surface washing machine similar to FIG. 6 but with the window shown askewed in a direction opposite that in FIG. 6.

As shown best in FIGS. 5-7, frame 20 is provided with guides 64 which engage vertical mullions 66, which mullions extend outwardly from the outer surface 68 of a building and are in the form of I-beams. As is common in most tall buildings being built today, mullions 66 are interspaced between window 27 and adjacent columns of windows (not shown). Guides 64 together with mullions 66 serve to guide the frame 20 along vertical paths of travel at a uniform distance outwardly of building face 68 and substantially sideways centered in respect to the window 27 being closed. Guides 64 includes sliding members 72 closely fitting and telescoping outwardly from each end of horizontally disposed tubular frame member 74 located at the upper forward portion of frame 20. Resilient means, such as a compression spring (not shown), can be placed centrally within horizontal frame member 74 to bear outwardly against each sliding member 72 to thus urge said sliding member 72 outwardly into engagement with mullions 66. Upper tubular member 74 is attached to each end of U-shaped frame member 76, which U-shaped frame member forms the upper end of frame 20. Likewise, sliding members 72 also telescope outward from each end of a lower tubular member 78 spaced parallel to and below upper tubular member 74 at an elevation intermediate the height of frame 20.

Mounted on each outer end of each sliding member 72 are a pair of mounting blocks 80 disposed in spaced horizontal relationship a distance sufficient for mounting closely therebetween an antifriction roller 82. Roller 82 is supported to rotate about a horizontal axis perpendicular to the length of sliding member 72 by an axle (not shown) extending through a clearance hole provided in said roller 82 and through aligned holes provided in each mounting block 80. In use, roller 82 contacts against the adjacent edge of outer flange 84 of mullions 66 of window 27 being cleaned as best shown in FIGS. 6 and 7. Furthermore, a pair of horizontally spaced rollers 86 are mounted on blocks 80 to rotate about a horizontal axis substantially perpendicular to the axis of rotation of roller 82. Each roller 86 is mounted on its corresponding mounting block 86 by a shaft 88, which shaft has an inner, threaded end receivable within a threaded hole provided in each of said mounting blocks 80. As best shown in FIGS. 6 and 7, each pair of rollers 86 are spaced horizontally apart a distance sufficient to closely receive therebetween the outer flange 84 of a mullion 66. Preferably, rollers 82 and 86 are of a material, such as nylon, which will not scratch or otherwise harm the outer surface finish of mullions 66.

Furthermore, it is to be appreciated that the construction of guides 64 enables rollers 82 and 86 to be retracted away from mullions 66, for instance, when the frame 20 is either at the top or bottom of the building. With guides 64 retracted, frame 20 can then be stepped sideways to the next column of windows to be cleaned. Sliding member 72 thereupon can be telescoped back outwardly so that rollers 82 and 86 again engage mullions 66. This telescoping construction is especially helpful if the mullions of the building being cleaned extend all the way downwardly to the ground level; thus, requiring guide means which must be capable of being disengaged from the mullions.

It should be noted that buildings may be provided with mullions of different cross-sectional shapes than the I-beam shaped mullions 66 shown in FIGS. 6 and 7. For instance, mullions can be constructed in the cross-sectional shapes of a channel or solid rectangle, in which instances it may be necessary to provide guides of a different structure than that disclosed above.

Electrical Cord Storage

Electricity for powering the electric motor of the winch drum 62 and other electrical motors (to be described below) is transmitted to the washing machine by an electrical cord (not shown) extending downwardly from the roof of a building. As frame 20 moves upwardly along the building face, the electrical cord is collected within the screened cage 90 shown in FIGS. 1, 2 and 5 as located at the section rear of said frame 20. Likewise, when frame 20 is moving downwardly, the electrical cord is paid out from within cage 90. Preferably cage 90 is in the form of an upwardly open, vertically elongate pocket or envelope, which pocket or envelope has a front, inner wall 92 inclined downwardly and rearwardly. Said front wall is formed by extending hardware cloth 93 or a similar material over horizontally extending top frame member 94, upper intermediate frame member 96, lower intermediate frame member 98 and bottom frame member 100, as best shown in FIG. 2. A rear wall 102 and side walls 104 are formed by extending hardware cloth 93 over portions of top U-shaped member 76, upper intermediate U-shaped frame member 106, lower intermediate U-shaped frame member 108 and bottom U-shaped frame member 110, respectively. A floor 112 for cage 90 is formed by laying either a solid or grated sheet of material on the top of bottom U-shaped frame member 110 and bottom horizontal member 100 and attaching said floor 112 to said frame members by welding, bolting or any other suitable means.

Scrubbing Brushes

Brush means 21 in the form of elongate, horizontally extending upper brush 22 and lower brush 23, as best shown in FIGS. 3, 8 and 9, are mounted spaced vertically apart on frame 20. Said pair of brushes 22 and 23 are powered to reciprocate back and forth to scrub the outer surface of window 27. Each brush 22 and 23 is formed by bristle members 114 extending forwardly and outwardly from a bead 116 to form a substantially horizontal bristle wall. Bead 116 is sandwiched between upper holding member 118 and lower holding member 120, which two holding members are clamped together by suitable fastening members such as cap screws 122.

Each brush 22 and 23 is mounted on frame 20 for reciprocating lengthwise back and forth through the use of four spaced, horizontally aligned swivel heads 124, which are best shown in FIGS. 3, 8 and 9. Each of said swivel heads is constructed from an annular shaped housing 126 cantilevered horizontally forwardly from vertically disposed mounting plate 128. Extending radially outwardly from each housing 126 are four triangular-shaped reinforcing plates 130 abutted aginst mounting plate 128 and angularly equally spaced around the circumference of said housing 126.

Journaled within each housing 126 through the use of anti-friction bearings is a pivot shaft 132. Each shaft 136 has a free end which is tightly pressed into a hole located centrally along the length of a vertically disposed rocker member 134. A stub shaft 136 is cantilevered horizontally rearwardly from each brush 22 and 23 to be pivotally received within corresponding holes provided within each rocker member 134. Each of said stub shafts is rigidly fixed to prevent any relative movement in respect to corresponding brushes 22 and 23 by being securely clamped between upper holding member 18 and lower holding member 120. However, the free or rear end portion of each stub shaft 136 is permitted to pivot freely in respect to corresponding rocker member 134 through the use of an anti-friction bearing disposed between each of said stub shafts 136 and the corresponding rocker member 134.

A guard 138 is bolted to each end of mounting plate 128 to protect operators from getting too close to the reciprocating upper and lower brushes 22 and 23, respectively. Guard 138 is formed from a base section 140 which is mounted on each end of mounting plate 128 by fasteners, such as cap screw 142, and a cantilevered section 144 which extends forwardly and diagonally outwardly from said base section. Said cantilevered section 144 is spaced a distance sufficiently outwardly of upper brush 22 and lower brush 23 to not interfere with the travel of said two brushes as they reciprocate back and forth.

Mounting plate 128, and thus brushes 22 and 23, is mounted on frame 20 through the use of a pair of horizontally disposed, parallel arms 146, which arms are cantilevered rearwardly from the rear surface of mounting plate 128. Each arm 146 is slidably received through bearings or guide holes 148 provided in each of the pair of front vertical frame plates 150 and each of the pair of rear vertical frame plates 152.

Brush Drive

A powered brush drive is provided to reciprocate upper brush 22 and lower brush 23 lengthwise back and forth relative to window 27 so that the said two brushes will both scrub and apply a thin film of cleaning liquid (described below) onto said window 27. As most clearly shown in FIG. 3, the brush drive means includes a motor 154, preferably of a type powered by electricity. Motor 154 is cantilevered rearwardly from a location centrally along the length of the rear surface mounting plate 128 through the use of standard fasteners such as cap screws 156 which extend through clearance holes provided in said mounting plate and then engage with corresponding tapped holes provided in said motor 154. A rotating drive shaft (not shown) of motor 154 extends horizontally forwardly through clearance hole 160 provided in mounting plate 128. A coupling collar 161 slides over the free end of the motor drive shaft, which collar is keyed to said drive shaft to prevent relative angular movement therewith. Furthermore, a fastener in the form of a set screw 162 extends through a threaded hole cross drilled in collar 161 and bears against the circumference of the motor drive shaft to prevent lengthwise relative movement therebetween.

Still referring to FIG. 3, one end of a connecting rod 163 is pivotally and eccentrically attached to the free end of collar 161 through the use of a pin 164. Said pin 164 has one end portion journaled within the connecting rod through the use of an anti-friction device such as a roller bearing (not shown) and has the other end fixedly attached to collar 161. The opposite end of connecting rod 163 is in the form of a clevis 165 for pivotally receiving the free end of connecting arm 166 between the clevis end. This connection is accomplished through the use of a clevis pin 167 extending through close filling, aligned holes in the clevis ends and through a bore provided in arm 166. Arm 166 is fixedly connected to the lower rear surface of an adjacent rocker member 134 by any suitable means.

Thus, when motor 154 is energized connecting rod 163, being eccentrically connected to collar 161, moves lengthwise back and forth as said collar rotates. This reciprocating movement of connecting rod 163 in turn causes adjacent rocker member 134 to pivot about its horizontal axis which thereby results in the lengthwise reciprocating movement of the upper and lower brushes 22 and 23, respectively.

Cleaning Liquid Supply Means

Cleaning liquid supply means 24 are provided for dripping cleaning liquid, as best shown in FIGS. 8 and 9, onto upper and lower brushes 22 and 23, respectively, in an amount sufficient to keep said two brushes wet and to enable them to supply a thin film of the cleaning liquid onto window 27. The cleaning liquid is stored in the bottom compartment 170 of a reservoir shown in the form of tank 56. Tank 56 is preferably constructed from a corrosion resistant material such as aluminum or stainless steel. Furthermore, said tank is divided into a lower compartment 170 and an upper compartment 172 by a flexible bladder or dividing wall 173, shown schematically in FIG. 4.

Cleaning liquid is introduced into lower compartment 170 through inlet valve 174, which inlet valve is in fluid flow communication with said lower storage compartment. Cleaning liquid leaves lower storage compartment 170 through an opening provided in the lower portion thereof and then is transported by well-known means such as pipes, tubes, or hoses through an electrically activated main solenoid valve 175 and then through either upper solenoid valve 176 or lower solenoid valve 177. If upper solenoid valve 176 is open, cleaning liquid is routed through four, horizontally spaced apart, upper branch pipes 178 and finally to the elongate, upper distributor pipe 25. Alternatively, if the upper solenoid valve 176 is closed and the lower solenoid valve 177 is open, then cleaning liquid is routed through a similar set of lower branch pipes 179 and finally to the elongate lower distributor pipe 26.

Both sets of upper and lower branch pipes 178 and 179, respectively, are spaced along the length of corresponding distributor pipes 25 and 26 to ensure that a uniform quantity of cleaning liquid is available along the entire length of said two distributor pipes. Said distributor pipes 25 and 26, as can be seen in FIGS. 8 and 9, are disposed closely above and along the length of upper brush 22 and lower brush 23. A series of small orifices 180 is provided in the underside of each distributor pipe 25 and 26 through which orifices cleaning liquid drips downward onto upper and lower brushes 22 and 23, respectively.

The lower distributor pipe 26 is used when frame 20 is traveling downwardly since in this direction of travel the lower brush 23 serves as the leading brush. Alternatively when frame 20 is traveling upwardly, the upper distributor pipe 25 is used in conjunction with the upper or leading brush 22.

By dripping cleaning liquid onto brushes 22 and 23 in this manner, as opposed to squirting cleaning liquid directly onto window 27, it is possible to clean said window while using a much smaller volume of cleaning liquid since brushes 22 and 23 themselves can apply a thin, uniform film of cleaning liquid uniformly onto window 27. If cleaning liquid were squirted directly on the window, a much larger volume of cleaning liquid would be required to insure that the entire surface area window 27 is wetted. Thus, by constructing the cleaning liquid supply means in the manner described above enables the use of a small volume of cleaning liquid to clean a relatively large window area so that valuable time is not spent repeatedly refilling storage tank 56.

Also, because the cleaning liquid is efficiently utilized, a relatively small volume of cleaning liquid is required to be carried by frame 12 at one time. Thus, the total weight of the washing machine of the instant invention can be reduced. This leads to other obvious advantages such as permitting the use of a smaller, lighter frame 20 and a smaller electric motor to power winch drum 62 than would be possible if cleaning liquid were instead squirted directly onto window 27. Furthermore, because the above structure only requires the use of a smaller volume of cleaning liquid to clean a given window area, almost no cleaning liquid is dripped down onto the ground below.

Squeegees

As shown in FIGS. 3, 4, and 8 through 10, an upper squeegee 28 and a lower squeegee 30 selectively function to wipe used cleaning liquid from window 27 and to collect said cleaning liquid generally at a leading edge portion 32 of squeegee blade portion 44. When frame 20 is moving downwardly, as shown in FIG. 8, the trailing or upper squeegee 28 makes wiping contact with window 27 while lower or leading squeegee 30 is spaced rearwardly away from window 27; alternatively, when frame 20 is traveling upwardly, shown in FIG. 9, trailing or lower squeegee 30 is in wiping contact with window 27 while upper or leading squeegee 28 is spaced rearwardly away from window 27. Upper and lower squeeges 28 and 30, respectively, being elongate extend substantially the entire length of upper brush 22 and lower brush 23. Furthermore, upper squeegee 28 is disposed closely above upper brush 22 and lower squeegee 30 is disposed closely below lower brush 23 thus enabling the used cleaning liquid and dirt particles suspended therein to be collected before said cleaning liquid is vaporized by the ambient heat.

Figure 10:
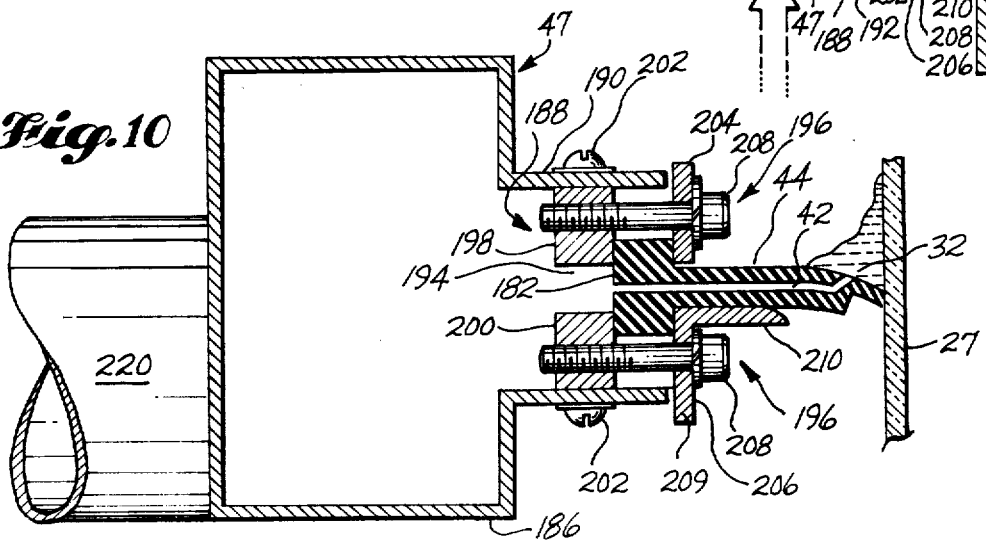
FIG. 10 is an enlarged partial cross-sectional view of the vertical surface washing machine shown in FIG. 9 specifically illustrating a squeegee.

As most clearly illustrated by FIG. 10, both upper and lower squeegees 28 and 30, respectively, include a base 182 of rectangular cross section and a forwardly extending, horizontal flexible blade 44, which flexible blade terminates at a leading edge portion 32. Also, it is to be noted that flexible blade 44 decreases in thickness as it extends toward leading edge portion 32. This construction insures that base 182 is rigid enough to be used as a mounting location while also insuring that blade 44 is flexible enough to satisfactorily wipe window 70. Blade 44 is shown constructed of discrete stepped sections having different thicknesses; however, it is to be appreciated that flexibility can be obtained by other means such as simply uniformly tapering blade section 44 in the direction of leading edge portion 32.

Suction System

Referring to FIGS. 3, 4, 8 and 9, a suction system 40 is provided to remove used cleaning liquid, which is collected at leading edge portion 32 of upper and lower squeegees 28 and 30, respectively, and return said cleaning liquid to upper compartment 172 of storage tank 56. As best shown in FIG. 10, passageways 42 extend transversely through both upper and lower squeegees 28 and 30. Each of said passageways has an inlet in the region of leading edge portion 32 whereat cleaning liquid is collected. From said inlets, each passageway 42 extends rearwardly and diagonally inwardly to a location approximately midway between the top and bottom surface of squeegee blade 44 and then extends horizontally rearwardly to an outlet at the rear edge of squeegee base 182.

Both upper squeegee 28 and lower squeegee 30 are mounted on and are in fluid receiving communication with an upper vacuum manifold 46 and a lower vacuum manifold 47, respectively. Each of said two vacuum manifolds has a horizontally elongate body portion 186 of rectangular cross-section, which body portion defines a vertical opening 188 in the wall of said body portion adjacent window 27. An upper lip 190 and a lower lip 192 extend horizontally outwardly from the upper and lower edge, respectively, of opening 188 in spaced parallel relationship to define an intake region 194 for upper and lower vacuum manifolds 46 and 47, respectively.

Mounting means 196 are provided to mount upper squeegees 28 and lower squeegees 32 on vacuum manifold 46 and lower vacuum manifold 47, respectively. Each of said mounting means includes an elongate upper bar 198 detachably attached to and extending sustantially the entire length of the lower surface of upper lip 190. A corresponding elongate lower bar 200 is positioned vertically below said upper bar 198 and is attached to the upper surface of lower lip 192. Said two bars, being elongate, extend substantially the entire length of upper and lower lips 190 and 192 and are attached thereto through the use of standard fasteners such as screws 202 extending through clearance holes provided along the lengths of upper and lower lips 190 and 192, and into aligned tapped holes located in said two bars. As FIG. 10 best illustrates, squeegee base 182 is clamped between upper bar 198 and horizontally elongate rectangular plate 204 and between lower bar 200 and a horizontally elongate angle 206. This clamping is accomplished through the use of standard fasteners such as cap screws 208 extending horizontally through closely fitting clearance holes provided in both plate 204 and vertical leg 209, angles 206 and then engaging corresponding threaded holes provided in upper bar 198 and lower bar 200, respectively.

Angle 206, as best shown in FIGS. 8 and 9, is mounted on upper vacuum manifold 46 so that horizontal leg 210 of said angle abuts the upper surface blade 44 of squeegee 28. However, angle 206 is mounted on lower vacuum manifold 47 so that horizontal leg 210 abuts the lower surface of blade 44 of lower squeegee 30. Mounting angle 206 in these positions enables said angle to support blade 44 whenever upper squeegee 28 and lower squeegee 30 are making wiping working contact with window 27 and thus prevents blade 44 from bending excessively. Furthermore, the edge of the free end of horizontal leg 210 which is adjacent to blade 44 has been radiused to prevent cutting or abraiding the adjacent surface of said blade 44.

Referring to FIG. 3, a vertically disposed, bristle wall 211 is mounted on the exterior of each end wall 212 of upper and lower vacuum manifolds 46 and 47, respectively. Bristle wall 211 is structured to extend laterally outwardly and forwardly to wipe the vertical edge portions of window 27 not reached by upper or lower squeegees 28 and 30, respectively.

Upper vacuum manifold 46, as shown in FIGS. 3, 8 and 9, is supported in horizontal orientation by support means in the form of a pair of upper tubular members 213, which upper tubular members are fixedly attached in fluid receiving communication to rear vertical wall 214 of body portion 186. Said two tubular members extend rearwardly in spaced horizontal relationship from rear vertical wall 214 and then extend through bearings or guide holes 216 provided in front vertical frame plates 150 and rear vertical frame plates 152. Lower vacuum manifold 47 is supported in horizontal orientation in a likewise manner with a pair of lower tubular members 220 extending rearwardly in spaced horizontal relationship through bearings or guide holes 216 provided in front vertical frame plates 150 and rear vertical frame plates 152. Although upper tubular members 213 and lower tubular members 220 are shown as round tubes, said tubular members can readily be of other cross-sections such as square or rectangular.

Attached in fluid receiving communication to the rearward or free end of each upper tubular member 213 and each lower tubular member 220 is an upwardly directed elbow 222. Flexible tubes 224 connect elbows 222 of upper tubular members 123 to a first intake bank 226 of manifold 228 as shown in FIG. 4. Likewise, flexible tubes 230 are provided to connect elbows 222 of lower tubular members 220 to a second intake bank 232 of manifold 228. As shown schematically in FIG. 4, both first and second intake banks 226 and 232, respectively, empty into a common outlet bank 234, which outlet bank is connected in fluid flow communication with the suction side 48 of vacuum pump 50 by the use of flexible hose 236.

In operation, vacuum pump 50 draws both the cleaning liquid collected at squeegee leading edge portion 32 together with a certain amount of the ambient air through passageways 42 and selectively into upper or lower vacuum manifolds 46 and 47, respectively. Providing a series of passageways 42 along the entire length of blade 44 has, for a given size of vacuum pump, been found to generate such a large amount of suction in the region of the leading edge portion 32 that not only is substantially all of the used cleaning liquid removed from window 27, but also part of the cleaning liquid is actually vaporized prior to entering passageways 42. Thus, this structure minimizes the amount of cleaning liquid which may drip downward onto the ground below.

Once collected in upper vacuum manifold 46 when frame 20 is traveling downwardly, as shown in FIG. 4, used cleaning liquid and air mixture is forced through upper tubular members 213 and then through flexible tubes 224 and into the first intake bank 226 of manifold 228. Said manifold 228 is provided with a first valve 238 located within first intake bank 226, which first valve is in open position. A second valve 240, which second valve is in closed position when frame 20 is traveling downward, is located within second intake bank 232. Finally, the cleaning liquid and air travel from manifold 228 to the suction side 48 of pump 50. Alternatively, when frame 20 is moving upwardly, cleaning liquid and air is forced from lower vacuum manifold 47, through lower tube members 220, through flexible tubes 230 and into second intake bank 232. Accordingly, when the window washer is operating in this mode, second valve 240 is in the open position while first valve 238 is in the closed position so that only one vacuum manifold operates at a time.

As can be seen in FIGS. 1, 2 and 5, vacuum pump 50 is bolted to the back side of frame 20 through the use of standard fasteners such as cap screws 242 extending through clearance holes provided in pump mounting plate 244 and through corresponding holes provided in vertical frame bars 246 and engage cap screws (not shown).

After reaching vacuum pump 50, the air and cleaning liquid mixture is forced out through exit side 52 of said vacuum pump, upwardly through flexible hose 248 and into separator 54, which separator is located in the upper portion of frame 20. Said separator 54 serves to separate the air from the cleaning liquid and then exhaust the air into the atmosphere thus resulting in used cleaning liquid which is substantially free of entrained air. Finally, the cleaning liquid 168 travels downwardly through valve 250 and into upper compartment 172 of storage tank 56.

If the present invention did not make as efficient use of cleaning liquid as it in fact does, it would be necessary to provide a filtering mechanism between separator 54 and storage tank 56 to remove the dirt from the cleaning liquid so that it could be reused. If a separator were not so provided, as is true of many existing window washers, it would not even be possible to make one complete upward or downward pass without having to refill the storage tank. Thus, the above described structure by efficiently utilizing cleaning liquid eliminates the need for a filtering mechanism and thus reduces the cost, complexity and weight of the window washer.

It can be appreciated that by dividing tank 56 into a lower storage compartment 170 and an upper compartment 172, the flexible bladder 173 enables the use of a minimum sized tank since both the unused and used cleaning liquid can be simultaneously stored in the same tank. Also, by storing the used cleaning liquid above the "clean" cleaning liquid, said "clean" cleaning liquid leaves tank 56 at substantially constant pressure regardless of how much said cleaning liquid has been used. This is especially important since cleaning liquid is supplied to distributor pipes 25 and 26 simply by gravity feed.

Extend-Retract Means and Biasing Means

Upper squeegee 28 and lower squeegee 30 are provided with identical extend-retract means 34 and 36, respectively. Said two extend-retract means operate to selectively extend the corresponding squeegee forward into working contact with window 27 or alternatively retract the corresponding squeegee rearward to a position spaced away from said window 27, depending on the direction of travel of frame 20, as will be more fully explained later. Likewise, the combined upper and lower brushes 22 and 23, respectively, also are jointly connected to extend-retract means 252 which is of a configuration essentially identical to said two squeegee extend-retract means 34 and 36.

As most clearly shown in FIGS. 3 and 5–7, each extend-retract means 34 and 36 comprises a pair of horizontally spaced apart linear actuators in the form of double-acting air cylinders 254, which air cylinders each have a body portion 256 extending horizontally through a vertical clearance hole provided in the corresponding front vertical frame plates 150. Each air cylinder 254 is mounted, in cantilever fashion, on a vertically disposed mounting plate 258 through the use of standard fasteners (not shown) extending through clearance holes provided in said mounting plate 258 and engaging into corresponding threaded holes provided in the adjacent end portion of air cylinder body portion 256. Each mounting plate 258 is maintained spaced forward or outward of the side of the corresponding front vertical frame plate 150 adjacent window 27 by the use of a plurality of spacer pins 259 which extend horizontally forward from each vertical frame plate 150 to the corresponding mounting plate 258.

A cylinder rod 260 extends horizontally outward from each body portion 256 through a clearance hole provided in mounting plate 258. The free end portion of each cylinder rod 206 is suitably connected to the spaced leg 262 of Z-bracket 264, which Z-bracket has an opposite leg 266 which is bolted to rear vertical wall 214 of the corresponding vacuum manifold body portion 186. The bolting is accomplished through the use of a standard fastener such as cap screw 268 extending through a clearance hole provided in leg 266 and into a corresponding tapped hole provided in rear vertical wall 214.

Air cylinders 258 serve as resilient urging means to maintain upper and lower squeegees 28 and 30 in uniform contact pressure against window 27. Because the air in cylinders 258 is compressible, cylinder rod 260 can readily retract to compensate for discontinuities or protrusions in the outer surface of window 27 and then extend again when the discontinuity has passed.

Furthermore, an air cylinder 258 is attached to each end portion of upper and lower squeegees 28 and 30, respectively, so that when the corresponding cylinder rods 260 are extended, the horizontal orientation of said two squeegees is adjusted to match the particular orientation of window 27. As can be seen in FIG. 6, one end of window 27 is disposed closer to building outer surface 68 than the opposite end, while in FIG. 7, window 27 is shown askewed to a position opposite that shown in FIG. 6. But, in both instances upper squeegee 28 is in uniform contact against window 27.

Bearing or guide holes 216 provided in front and rear vertical frame plates 150 and 152, respectively, are larger than the diameter of upper and lower tubular members 213 and 220, respectively. Thus, when the corresponding vacuum manifolds 46 and 47 are horizontallly askewed in respect to front vertical frame plate 150, upper and lower tubular members 213 and 220 also are free to angularly adjust to the orientation of the corresponding vacuum manifolds. As shown in FIGS. 6 and 7, it should be noted that compression springs 272, by applying a substantially constand load against the corresponding Z-bracket 264, enable the entire length of the corresponding squeegee to be held in substantially uniform contact pressure against window 27 no matter what particular orientation said window happens to be askewed in.

Extend-retract means 252, similar to those provided for upper and lower squeegee means 30 and 32, respectively, are also provided for brush means 21. As best shown in FIG. 3, said extend-retract means 252 inclues a pair of horizontally spaced apart linear actuators in the form of air bylinders 276, which air cylinders are mounted on front vertical frame plates 150 and serve to extend brush means 21 forwardly into working contact with window 27, or alternatively retract said brush means 21 rearwardly away from window 27. Each said air cylinder 276 has a body portion 278, which body portion is mounted to cantilever rearwardly from the vertical surface of each plate 150 opposite window 27. Standard fasteners such as cap screws (not shown) are used to extend rearwardly through clearance holes provided in each front vertical frame plate 150 and into aligned threaded holes located in the front face of each air cylinder body portion 278.

A cylinder rod 280 extends horizontally forward through a clearance hole provided in each front vertical frame plate 150. The free end of cylinder rod 280 is suitably connected to free leg 282 of a corresponding Z-bracket 284. Said Z-bracket 284 is mounted to the rear vertical face of mounting plate 128 through the use of standard fasteners such as a cap screw 286 extending forwardly through a clearance hole provided in a second Z-bracket leg 288 and then engaging with a tapped hole provided in said mounting plate 128.

Air cylinders 276 act as resilient urging means to maintain brush means 21 in uniform contact pressure against window 27. Because the air in cylinders 276 is compressible, clyinder rod 280 can readily retract to compensate for discontinuities in the outer surface of windows 27 and then extends again once the discontinuity is passed.

Furthermore, to enable brush means 21 to adjust to the plane of window 27, so that upper brush 21 and lower brush 22 are in uniform contact with window 27, said brush means must be free to angularly adjust about a vertical axis. This particular movement is made possible because bearing or guide holes 148, provided in each front vertical frame plate 150, and each rear vertical frame plate 152 are of a size larger than the diameter of arms 146. Thus, arms 146 are permitted to swing laterally while still supporting brush means 21 in substantially horizontal orientation.

Pressurized air is supplied to upper squeegee extend-retract means 34, lower squeegee extend-retract means 36, and brush extend-retract means 252 through the use of an electrically powered air compressor 296, which air compressor is mounted on the bottom portion of frame 20 as a location near winch drum 62. Upon discharge from vacuum pump 296, the compressed air is routed through pressure switch 298 and into a storage tank 300, which storage tank is located alongside winch drum 62. From said storage tank, compressed air is supplied selectively to either the cap end side or rod end side of each said extend-retract means through the use of the control circuit schematically shown in FIG. 4.

In FIG. 4, upper and lower squeeges 28 and 30, respectively, and brush means 21 are shown adjusted for downward travel of frame 20. Specifically, compressed air after traveling through a com pressure regulator 301 and then through a second pressure regulator 302, passes through first solenoid valve 304 and then into the cap end side 306 of each air cylinder 254 of upper extend-retract means 34 to thus extend upper squeegee 28 into contact with window 27. The air located within the rod end side 308 of each air cylinder 254 is allowed to exhaust into the atmosphere through secons solenoid valve 310.

To maintain lower squeegee 30 spaced rearwardly away from window 27, compressed air from storage tank 300, passes through a third solenoid valve 312 and then into the rod end side 308 of each air cylinder 254 of lower extend-retract means 36. Compressed air located in the cap end side 306 of each of said air cylinders is permitted to exhaust into the atmosphere through a fourth solenoid valve 314. It is to be appreciated that when frame 20 is traveling upwardly, compressed air is supplied to the opposite ends of air cylinders 254 than when frame 20 is traveling downwardly as shown in FIG. 4.

Referring again to FIG. 4, compressed air is supplied from storage tank 300 through a fifth solenoid valve 316, then through a third pressure regulator 318 and finally into the cap end side 320 of each brush means air cylinder 276 to thus force brush means 21 forward into working contact with window 27. Simultaneously, compressed air located in the rod end side 322 of each said air cylinder 276 is permitted to exhaust into the atmosphere through a sixth solenoid valve 324. If instead, it is desired to retract brush means 21 rearwardly to a location spaced away from window 27, fifth solenoid valve 316 and sixth solenoid valve 324 are switched to their opposite positions so that compressed air is supplied to the rod end side 322 of each sir cylinder 276. Simultaneously, air located in the cap end side 320 of said air cylinders 276 is permitted to exhaust into the atmosphere through sixth solenoid valve 324.

Although the linear actuators are described as air cylinders 254 and air cylinders 276, linear actuators of other types such as vacuum cylinders or hydraulic cylinders can also be used. Perhaps a different type of solenoid valve would have to be provided to correspond to the particular medium being used. However, the operation of said solenoid valves will be essentially as described below.

Operation

Prior to actually cleaning window 27, storage tank 56 must first be charged with unused cleaning liquid. As best shown in FIG. 4, this is accomplished by first closing valve 250 so that any used cleaning liquid which may be in upper storage compartment 172 is not forced back into separator 54. Drain valve 326 and inlet valve 174 are both opened so that cleaning liquid can be introduced into lower storage compartment 170. After tank 56 is filled with cleaning liquid, drain valve 326 and inlet valve 174 are closed and valve 250 reopened.

Assuming that storage tank 56 is filled while located on the roof of the building, after guides 64 are engaged with the mullions 66 of the particular column of windiws to be cleaned, upper squeegee 28 and brush means 21 are extended into contact with window 27 while lower squeegee means 30 is retracted away from said window. To enable frame 20 to travel downwardly winch drum 62 is operated to unwind. Simultaneously, main solenoid valve 175 and lower solenoid valve 177 are switched open so that cleaning liquid is supplied to lower distributor pipe 26; motor 154 is energized to reciprocate upper and lower brushes 22 and 23, respectively, to thus scrub window 27; and vacuum pump 50 is energized to both remove used cleaning liquid from the leading edge portion 32 of upper squeegee 28, shown in FIG. 8, and return said cleaning liquid to the upper compartment 172 of storage tank 56.

Upon reaching the bottom of the column of windows, main solenoid valve 175 and lower solenoid valve 177 are switched off to stop the flow of cleaning liquid; and upper squeegee 28 and brush means 21 are both retracted. Frame 20 is thereafter stepped sideways to the next column of windows, with guides 64 engaging the corresponding mullions. Then, lower squeegee 30 and brush means 21 are both extended into working contact with the new column of windows. Main solenoid valve 175 and upper solenoid valve 176 are switched open to enable cleaning liquid to drip downward from upper distributor pipe 25 onto upper brush 22. During the stepping process brush motor 154 can be switched off or, alternatively, kept operating. Vacuum manifold 228 is switched so that cleaning liquid is now removed from the leading edge portion 32 of lower squeegee 30 and collected in upper compartment 172 of storage tank 56. Winch drum 62 is now reversed to the wind-up mode so that frame 20 travels upwardly.

It can now be appreciated that the combined effect of dripping cleaning liquid downwardly onto brushes 22 and 23; placing a squeegee 28 and 30 closely above and below said brushes; providing passageways 42 through the squeegees themselves; and and placing inlets for such passageways 42 at the leading edge portion 32 of each squeegee, where cleaning liquid is collected not only requires a minimum amount of cleaning liquid to be used to clean a relatively large vertical surface area, but also enables the recapture of essentially all of the cleaning liquid so that none falls downward onto the ground below. The vertical surface washing machine, essentially as described above, has been used to clean 2000 linear feet of window glass, 43 inches wide, with only 1½ gallons of cleaning liquid.

Upon reaching the top of the building, the previously described stepping procedure can be repeated so that the next column of windows can be cleaned while frame 20 is traveling downwardly. If however, all the windows have been cleaned, solenoid valve 176 can be switched off to prevent the flow of unused cleaning liquid, and also lower squeegee 30 and brush means 21 can be retracted away from the windows. Furthermore, motor 154 of brush means 21, vacuum pump 50 and air compressor 296 can all be switched off.

At the end of a predetermined number of vertical passes, it will be necessary to remove the used cleaning liquid from storage tank 56 and recharge said tank with new cleaning liquid. The structure of storage tank 56 enables both operations to be performed simultaneously. This is accomplished by first closing valve 250 and opening drain valve 326. Thereafter, inlet valve 174 is opened so that new cleaning liquid can be introduced into lower compartment 170. While said lower compartment is being filled, the flexible dividing wall 174 enables the used cleaning liquid to be displaced from upper compartment 172 and removed therefrom through drain valve 326. Once lower compartment 170 is filled, both inlet valve 180 and drain valve 326 can be closed, and then valve 250 reopened. The vertical surface washing machine of the instant invention is now ready to continue its cleaning operation.

What is claimed is:

1. A vertical surface washing machine which in use moves vertically alongside of a vertical surface to be washed, comprising:

at least one brush which in use is in contact with the vertical surface;

means for dripping a cleaning liquid downwardly onto said brush at a location adjacent the vertical surface and in a sufficient amount to keep such brush wet and enable it to apply a film of cleaning liquid onto the vertical surface;

power means for moving said brush relative to said vertical surface, so that the brush will both scrub such surface and apply a film of cleaning liquid onto it;

squeegee means mounted in close proximity to said brush, and in use making wiping contact with the portion of the vertical surface which is wetted by the film of cleaning liquid and functioning to wipe the cleaning liquid from such surface and collect it generally at a leading edge portion of said squeegee; and suction means for removing the cleaning liquid from the leading edge region of the squeegee, said suction means providing suction only at a location adjacent said leading edge region of said squeegee.

2. A vertical surface washing machine which in use moves vertically alongside of a vertical surface to be washed, comprising:

at least one brush which in use is in contact with the vertical surface;

means for dripping a cleaning liquid onto said brush in a sufficient amount to keep such brush wet and enable it to apply a film of cleaning liquid onto the vertical surface;

power means for moving said brush relative to said vertical surface, so that the brush will both scrub such surface and apply a film of cleaning liquid onto it;

squeegee means mounted in close proximity to said brush, and in use making wiping contact with the portion of the vertical surface which is wetted by the film of cleaning liquid and functioning to wipe the cleaning liquid from such surface and collect it generally at a leading edge portion of said squeegee;

suction means for removing the cleaning liquid from the leading edge region of the squeegee; and wherein said squeegee means comprises a flexible blade, and wherein the suction means includes passageways extending through said blade and a vacuum manifold in fluid receiving communication with said passageways.

3. A vertical surface washing machine according to claim 2, wherein said flexible blade and said vacuum manifold each extend laterally of the path of travel of said washing machine, wherein said flexible blade is mounted on said manifold, to be carried thereby, and wherein said passageways have inlets in the region of said blade whereat cleaning liquid is collected.

4. A vertical surface washing machine according to claim 1, further comprising:

a reservoir having an interior which is divided into two compartments by a flexible wall, with one of said compartments being a storage compartment for clean cleaning liquid and the other being a storage compartment for used cleaning liquid;

said means for dripping the cleaning liquid onto said brush including a distributor pipe having orifices contiguous to the brush and conduit means leading from the clean cleaning liquid storage compartment ot the distributor pipe;

said suction means further including conduit means for delivering used cleaning liquid collected thereby into the used cleaning liquid storage compartment of said reservoir; and, means for introducing clean cleaning liquid into said clean cleaning liquid storage compartment and means for discharging used cleaning liquid from said used cleaning liquid compartment, whereby introduction of clean cleaning liquid into said clean cleaning liquid compartment will, due to the presence of the flexible wall between the two compartments, simultaneously fill said clean cleaning liquid storage compartment and discharge used cleaning liquid from said used cleaning liquid storage compartment.

5. A vertical surface washing machine which in use moves vertically alongside of a vertical surface to be washed, comprising:

at least one brush which in use is in contact with the vertical surface;

means for dripping a cleaning liquid onto said brush in a sufficient amount to keep such brush wet and enable it to apply a film of cleaning liquid onto the vertical surface;

power means for moving said brush relative to said vertical surface, so that the brush will both scrub such surface and apply a film of cleaning liquid onto it;

squeegee means mounted in close proximity to said brush, and in use making wiping contact with the portion of the vertical surface which is wetted by the film of cleaning liquid and functioning to wipe the cleaning liquid from such surface and collect it generally at a leading edge portion of said squeegee;

suction means for removing to cleaning liquid from the leading edge region of the squeegee;

a reservoir having an interior which is divided into two compartments by a flexible wall, with one of said compartments being a storage compartment for clean cleaning liquid and the other being a storage compartment for used cleaning liquid, said means for dripping the cleaning liquid onto said brush including a distributor pipe having orifices contiguous to the brush and conduit means leading from the clean cleaning liquid storage compartment to the distributor pipe, and said suction means further including conduit means for delivering used cleaning liquid collected thereby into the used cleaning liquid storage compartment of said reservoir; and wherein said squeegee means comprises a flexible blade, and wherein the suction means includes passageways extending through said blade and a vacuum manifold in fluid receiving communication with said passageways.

6. A vertical surface washing machine according to claim 5, wherein said flexible blade and said vacuum manifold each extend laterally of the path of travel of said washing machine, wherein said flexible blade is mounted on said manifold, to be carried thereby, and wherein said passageways have inlets in the region of said blade whereat cleaning liquid is collected.

7. A vertical surface washing machine for washing a vertical surface during both upward and downward passes which in use moves vertically alongside of a vertical surface to be washed, comprising:

at least one brush which in use is in contact with the vertical surface;

means for dripping a cleaning liquid onto said brush in a sufficient amount to keep such brush wet and enable it to apply a film of cleaning liquid onto the vertical surface;

power means for moving said brush relative to said vertical surface, so that the brush will both scrub such surface and apply a film of cleaning liquid onto it;

squeegee means mounted in close proximity to said brush, and in use making wiping contact with the portion of the vertical surface which is wetted by the film of cleaning liquid and functioning to wipe the cleaning liquid from such surface and collect it generally at a leading edge portion of said squeegee;

suction means for removing the cleaning liquid from the leading edge region of the squeegee; and a first squeegee means of the character described and a first suction means of the character described, positioned above said brush, a second squeegee means of the character described and second suction means of the character described, positioned below said brush, a first extend-retract means connected with said first squeegee means and said first suction means, and a second extend-retract means connected with said second squeegee means and said second suction means, said first and second extend-retract means functioning to extend the squeegee means and the suction means which are on the trailing side of the brush into operative positions contiguous to the vertical surface, and to retract the other squeegee means and other suction means away from the vertical surface, into inoperative positions.

8. A vertical surface washing machine according to claim 7, wherein each squeegee means comprise a squeegee blade and each vacuum means comprises a plurality of passageways extending through the squeegee blade, and a vacuum manifold in fluid receiving communication with said passageways.

9. A vertical surface washing machine according to claim 8, wherein said flexible blade and said vacuum manifold each extend laterally of the path of travel of said washing machine, wherein said flexible blade is mounted on said manifold, to be carried thereby, and wherein said passageways have inlets in the region of said blade whereat cleaning liquid is collected.

10. A machine for washing a vertical surface of a tall structure, comprising:

frame means movable vertically up and down alongside of such vertical surface, including means for guiding said frame along defined vertical paths of travel; and washing equipment carried by said frame, comprising:

at least one brush which in use is in contact with the vertical surface;

means for dripping a cleaning liquid downwardly onto said brush at a location closely adjacent said vertical surface and in a sufficient amount to keep such brush wet and enable it to apply a film of cleaning liquid onto the vertical surface;

power means for moving said brushes relative to said vertical surface, so that the brush will both scrub such surface and apply a film of cleaning liquid onto it;

squeegee means mounted in close proximity to said brush, and in use making wiping contact with the portion of the vertical surface which is wetted by the film of cleaning liquid and functioning to wipe the cleaning liquid from such surface and collect it generally at a leading edge portion of said squeegee; and suction means for removing the cleaning liquid from the leading edge region of the squeegee by providing suction only along a localized location closely adjacent to said liquid collecting leading edge portion of said squeegee.

11. A machine for washing a vertical surface of a tall structure, comprising:

frame means movable vertically up and down alongside of such vertical surface, including means for guiding said frame along defined vertical paths of travel;

washing equipment carried by said frame, comprising:

at least one brush which in use is in contact with the vertical surface;

means for dripping a cleaning liquid onto said brush in a sufficient amount to keep such brush wet and enable it to apply a film of cleaning liquid onto the vertical surface;

power means for moving said brushes relative to said vertical surface, so that the brush will both scrub such surface and apply a film of cleaning liquid onto it;

squeegee means mounted in close proximity to said brush, and in use making wiping contact with the portion of the vertical surface which is wetted by the film of cleaning liquid and functioning to wipe the cleaning liquid from such surface and collect it generally at a leading edge portion of said squeegee; and suction means for removing the cleaning liquid from the leading edge region of the squeegee; and wherein said squeegee means comprises a flexible balde, and wherein the suction means includes passageways extending through said blade and a vacuum manifold in fluid receiving communication with said passageways.

12. A vertical surface washing machine according to claim 11, wherein said flexible blade and said vacuum manifold each extend laterally of the path of travel of said washing machine, wherein said flexible blade is mounted on said manifold, to be carried thereby, and wherein said passageways have inlets in the region of said blade whereat cleaning liquid is collected.

13. A vertical surface washing machine according to claim 11, further including support means for said vacuum manifold in fluid recovery communication with said vacuum manifold, said support means, being in fluid recovery communication with said vacuum manifold, functions as passageways for removing used cleaning fluid from said vacuum manifold, and also functions to mount said vacuum manifold on said frame both for movement of said vacuum manifold relative to said frame toward and away from the window and for angular adjustment of said vacuum manifold about a vertical axis.

14. A vertical surface washing machine according to claim 13, wherein said vacuum manifold support means includes a plurality of tubular members extending rearwardly from said vacuum manifold in a direction opposite the vertical surface, and wherein said frame includes bearings for slidably receiving said tubular members.

15. A vertical surface washing machine according to claim 10, further comprising brush mounting means for mounting said brush on said frame and for supporting said brush for movement relative to said frame toward and away from the vertical surface, and for angular movement about an axis colinear with the direction of travel of said washing machine to accommodate vertical surfaces skewed about an axis colinear with the direction of travel of said washing machine.

16. A vertical surface washing machine according to claim 15, wherein the brush mounting means includes a vertical mounting plate with said brush mounted on a face of said mounting plate adjacent the vertical surface and with said power means mounted on a face of said mounting place opposite the vertical surface, and a plurality of arms extending rearwardly from the face of said mounting place opposite the vertical surface.

17. A vertical surface washing machine according to claim 10, further comprising a tank having an interior which is divided into two variable volume compartments by a flexible wall, with one of said compartments being a storage compartment for clean cleaning liquid and the other being a storage compartment for used cleaning liquid; and means for simultaneously introducing clean cleaning liquid into said clean cleaning liquid storage compartment and removing used cleaning liquid from said used cleaning liquid storage compartment.

18. A machine for washing a vertical surface of a tall structure, comprising:

frame means movable vertically up and down alongside of such vertical surface, including means for guiding said frame along defined vertical paths of travel;

washing equipment carried by said frame, comprising:

at least one brush which in use is in contact with the vertical surface;

means for dripping a cleaning liquid onto said brush in a sufficient amount to keep such brush wet and enable it to apply a film of cleaning liquid onto the vertical surface;

power means for moving said brushes relative to said vertical surface, so that the brush will both scrub such surface and apply a film of cleaning liquid onto it;

squeegee means mounted in close proximity to said brush, and in use making wiping contact with the portion of the vertical surface which is wetted by the film of cleaning liquid and functioning the wipe the cleaning liquid from such surface and collect it generally at a leading edge portion of said squeegee; and suction means for removing the cleaning liquid from the leading edge region of the squeegee;

a tank having an interior which is divided into two variable volume compartments by a flexible wall, with one of said compartments being a storage compartment for clean cleaning liquid and the other being a storage compartment for used cleaning liquid, said means for dripping the cleaning liquid onto said brush including a distributor pipe having orifices contiguous to the brush and conduit means leading from the clean cleaning liquid storage compartment to the distributor pipe, and said suction means including conduit means for delivering used cleaning liquid collected thereby into the used cleaning liquid storage compartment of said tank; and wherein said squeegee means comprises a flexible blade, and wherein the suction means includes passageways extending through said blade and a vacuum manifold in fluid receiving communication with said passageways.

19. A vertical surface washing machine according to claim 18, wherein said flexible blade and said vacuum manifold each extend laterally of the path of travel of said washing machine, wherein said flexible blade is mounted on said manifold, to be carried thereby, and wherein said passageways have inlets in the region of said blade whereat cleaning liquid is collected.

20. A machine for washing a vertical surface of a tall structure during both upward and downward passes, comprising:

frame means movable vertically up and down alongside of such vertical surface, including means for guiding said frame along defined vertical paths of travel;

washing equipment carried by said frame, comprising:

at least one brush which in use is in contact with the vertical surface;

means for dripping a cleaning liquid onto said brush in a sufficient amount to keep such brush wet and enable it to apply a film of cleaning liquid onto the vertical surface;

power means for moving said brushes relative to said vertical surface, so that the brush will both scrub such surface and apply a film of cleaning liquid onto it;

squeegee means mounted in close proximity to said brush, and in use making wiping contact with the portion of the vertical surface which is wetted by the film of cleaning liquid and functioning to wipe the cleaning liquid from such surface and collect it generally at a leading edge portion of said squeegee; and suction means for removing the cleaning liquid from the leading edge region of the squeegee; and a first squeegee means of the character described and a first suction means of the character described, positioned above the brush, a second squeegee means of the character described, and second suction means of the character described, positioned below said brush, a first extend-retract means connected with said first squeegee means and said first suction means, and a second extend-retract means connected with said second squeegee means and said second suction means, said first and second extend-retract means functioning to extend the squeegee means and the suction means which are on the trailing side of the brush into operative positions contiguous to the vertical surface, and to retract the other squeegee means and other suction means away from the vertical surface, into inoperative positions.

21. A vertical surface washing machine according to claim 20, wherein each of said extend-retract means includes biasing means for maintaining said extended squeegee means in uniform contact pressure against the vertical surface.

22. A vertical surface washing machine according to claim 21, wherein each squeegee means comprises a squeegee blade and each vacuum means comprises a plurality of passageways extending through the squeegee blade, and a vacuum manifold in fluid receiving communication with said passageways.

23. A vertical surface washing machine according to claim 22, wherein said flexible blade and said vacuum manifold each extend laterally of the path of travel of said washing machine, wherein said flexible blade is mounted on said manifold, to be carried thereby, and wherein said passageways have inlets in the region of said blade whereat cleaning liquid is collected.

24. In a vertical surface washing machine which in use moves vertically alongside of a vertical surface to be washed and applies a cleaning liquid to such surface, means for removing cleaning liquid from the vertical surface during vertical travel of the washing machine, comprising an elongated vacuum manifold which extends laterally of the path of travel of the washing machine, and a squeegee blade carried by said manifold, said squeegee blade including a relatively flexible free edge portion which makes contact with the vertical surface and serves to wipe the cleaning liquid from it and collect such liquid generally forwardly of said flexible free edge portion, said blade including a plurality of passageways leading from the region of said blade whereat washing liquid is collected, through said squeegee blade, into the vacuum manifold.

25. Apparatus according to claim 24, wherein said passageways constitute the only inlets into the vacuum manifold for such cleaning liquid.

26. A vertical surface washing machine according to claim 10:

wherein said brush is horizontally elongate; and further comprising brush mounting means for mounting said brush on said frame for linear movement relative to said frame toward and away from the vertical surface and also for angular movement relative to said frame about a vertical axis.

* * * * *